US007204051B2

(12) United States Patent
Thomele et al.

(10) Patent No.: US 7,204,051 B2
(45) Date of Patent: Apr. 17, 2007

(54) SAFETY FOR A HAND FIREARM

(75) Inventors: Adrian Thomele, Holtsee (DE); Thomas Metzger, Eckernförde (DE)

(73) Assignee: S.A.T. Swiss Arms Technology AG, Neuhausen (CH)

( * ) Notice: Subject to any disclaimer, the term of this patent is extended or adjusted under 35 U.S.C. 154(b) by 22 days.

(21) Appl. No.: 11/055,576

(22) Filed: Feb. 9, 2005

(65) Prior Publication Data

US 2006/0048428 A1 Mar. 9, 2006

(30) Foreign Application Priority Data

Feb. 19, 2004 (EP) ..... 04003783

(51) Int. Cl.
*F41A 17/72* (2006.01)

(52) U.S. Cl. ..... 42/70.08; 42/69.03

(58) Field of Classification Search ..... 42/70.01, 42/70.08, 69.03

See application file for complete search history.

(56) References Cited

U.S. PATENT DOCUMENTS

| | | | | |
|---|---|---|---|---|
| 3,724,113 | A * | 4/1973 | Ludwig | 42/70.08 |
| 3,830,002 | A * | 8/1974 | Volkmar | 42/70.08 |
| 4,021,955 | A | 5/1977 | Curtis | |
| 4,555,861 | A * | 12/1985 | Khoury | 42/69.01 |
| 4,843,748 | A * | 7/1989 | Tuma | 42/70.08 |
| 5,157,209 | A * | 10/1992 | Dunn | 42/70.08 |
| 5,245,776 | A * | 9/1993 | Dornaus | 42/70.08 |
| 5,437,120 | A * | 8/1995 | Dornaus | 42/70.08 |
| 5,493,806 | A * | 2/1996 | Langevin et al. | 42/70.08 |
| 6,256,918 | B1 * | 7/2001 | Szabo | 42/70.08 |
| 6,374,526 | B1 * | 4/2002 | Mochak | 42/70.08 |
| 6,460,282 | B1 * | 10/2002 | Bustos | 42/70.08 |
| 6,470,615 | B1 * | 10/2002 | Peterken | 42/70.01 |
| 6,510,641 | B1 * | 1/2003 | Viani | 42/70.08 |
| 6,588,136 | B2 * | 7/2003 | Baker et al. | 42/70.08 |
| 6,647,655 | B2 * | 11/2003 | Salvitti | 42/70.08 |
| 6,941,692 | B1 * | 9/2005 | Krinke et al. | 42/70.08 |

FOREIGN PATENT DOCUMENTS

| | | |
|---|---|---|
| CH | 338 381 | 5/1959 |
| EP | 1 281 924 A1 | 2/2003 |
| FR | 2 480 928 | 10/1981 |
| GB | 660 046 | 10/1951 |

* cited by examiner

*Primary Examiner*—Teri Luu
*Assistant Examiner*—Bret Hayes
(74) *Attorney, Agent, or Firm*—Martin Fleit; Paul D. Bianco; Fleit Kain Gibbons Gutman Bongini & Bianco P.L.

(57) ABSTRACT

A safety for a hand firearm with a firing lever, a firing pin, a safety element allocated to the firing pin, a trigger rod that can be activated by a trigger, and a transmission element, which is coupled to the trigger rod and through which the safety element can be moved from a safety position for blocking the firing pin into a released position for releasing the firing pin. To guarantee a high degree of safety against undesired firing of a shot even for a small trigger path and low trigger weight, the transmission element contains a control element, through which the transmission element can be activated in a predetermined trigger position of the trigger by means of the firing lever for moving the safety element into the released position.

13 Claims, 5 Drawing Sheets

SAFETY FOR A HAND FIREARM

BACKGROUND OF THE INVENTION

1. Field of the Invention

The invention pertains to a safety for a hand firearm.

2. Prior Art

Mechanical safeties for hand firearms are already known, in which a safety element interacting with the firing pin is activated by means of a transmission element coupled to the trigger rod. The transmission element transmits the motion of the trigger rod to the safety element such that the safety element is biased into a safety position, usually by a spring until a desired trigger point is reached. Then, the safety element is released by the rocking lever into a released position. However, if the trigger path in such safety systems is to be shortened, there is the problem that the resulting smaller shifting of the trigger rod is no longer sufficient to move the safety element from the predetermined safety position into the released position. The path provided between the safety position and the released position of the safety element should not be selected too small because otherwise the safety function could be canceled just by small vibrations or impacts. Increasing the spring force on the safety element in the safety position would in turn increase the trigger weight, which could have a negative effect on the firing behavior.

The problem dealt with by the invention is the design of a safety, which guarantees a high degree of safety against undesired firing of a shot even for a small trigger path and low trigger weight.

SUMMARY OF THE INVENTION

This problem is solved by the present invention by providing a safety with the features described in detail hereinafter. Preferred configurations and advantageous refinements of the invention are also described.

In the safety according to the invention, the transmission element for moving the safety element is first activated by the trigger rod. Only when the trigger reaches a predetermined trigger position does a control element on the transmission element reach the transmission lever in a position in which it can contact the hammer and is activated by this lever for moving the safety element into the released position. The moving of the safety element into the released position no longer has to be realized completely by the trigger rod, which means that the trigger path can be shortened. The connection between the transmission element and the hammer, however, is designed such that the movement of the transmission element through the firing pin for releasing the safety can be realized only when the trigger is located in the desired trigger position. This configuration guarantees safety against undesired firing of a shot even for a shortened trigger path.

In a structurally preferred configuration, the control element on the transmission element engages in a lateral recess of the hammer until the predetermined trigger position is reached. The control element contains a rear control surface, which is led into contact with a radial cam of the hammer only in the predetermined trigger position in order to generate the movement of the safety element into the released position by the hammer.

The transmission element is preferably formed as a rotary lever, which can be manufactured as a stamped and bent part. The control element is a bracket, which is bent inwards and whose rear side has a control surface for contact with the radial cam of the hammer. The transmission element with the control element, however, can also be produced from a solid block or realized in some other way.

BRIEF DESCRIPTION OF THE DRAWINGS

Further characteristic features and advantages of the invention will become apparent from the following description of a preferred embodiment with reference to the drawings. Shown are.

a.

b.

c.

d.

DETAILED DESCRIPTION OF PREFERRED EMBODIMENTS OF THE INVENTION

Figure 1:
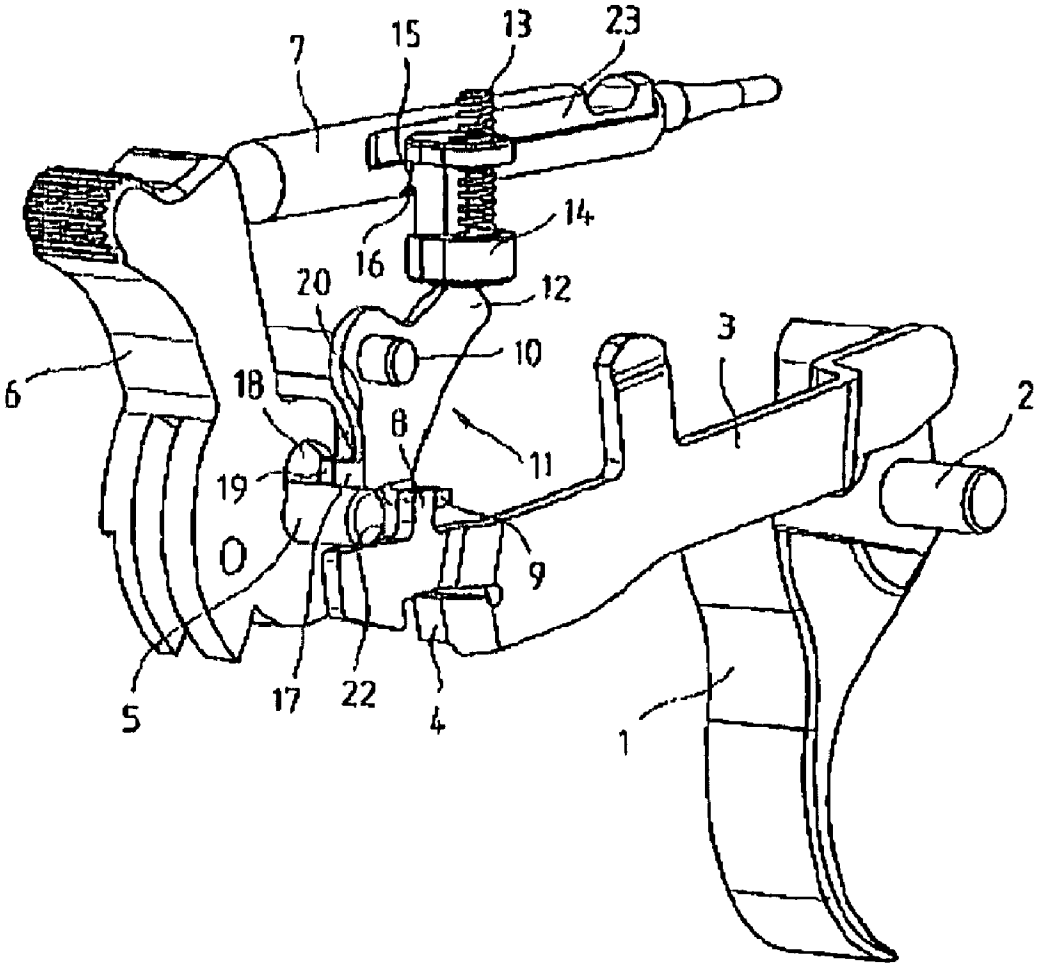
FIG. 1, a safety of a hand firearm in a schematic perspective view.

FIG. 1 shows a trigger 1, which is arranged in a not-shown handle, an insert, or another suitable part of a hand firearm so that it can rotate about a trigger pin 2. The front end of a trigger rod 3 is hinged to a part of the trigger 1 lying above the trigger pin 2 such that the trigger rod 3 is moved forward when the trigger 1 is activated. In the rear region of the trigger rod 3, on the bottom side there is a projection 4, which is bent inwards and which is used to activate a releasing lever, which is not shown here. The hammer 6 that can rotate about a hammer shaft 5 and that is biased by a hammer spring is released by the releasing lever for striking a firing pin 7. This function is known, so that the illustration of the releasing lever interacting with the projection 4, as well as other components not required for the description of the safety have been omitted for reasons of clarity.

In the rear region of the trigger rod 3, on its top side there is a tab 8, which projects upwards and which engages with a connecting piece 9 bent outwards in the direction of the trigger rod 3 at the lower end of a transmission element 11 that can rotate about a transverse shaft 10. The upper end 12 of the transmission element 11 embodied as a rotary lever contacts a safety element 14, which is biased downwards by a spring 13 and which has an inner projection 15 extending in the direction of the firing pin 7 for engaging in a corresponding lateral safety groove 16 on the firing pin 7. By means of the transmission element 11, the safety element 14 embodied as a safety slide can move between a lower position shown in FIG. 1, in which the projection 15 engages in the safety groove 16 and blocks the firing pin 7, and an upper released position, in which the projection 15 is led out of engagement with the safety groove 16 and releases the firing pin 7.

Figure 2B:
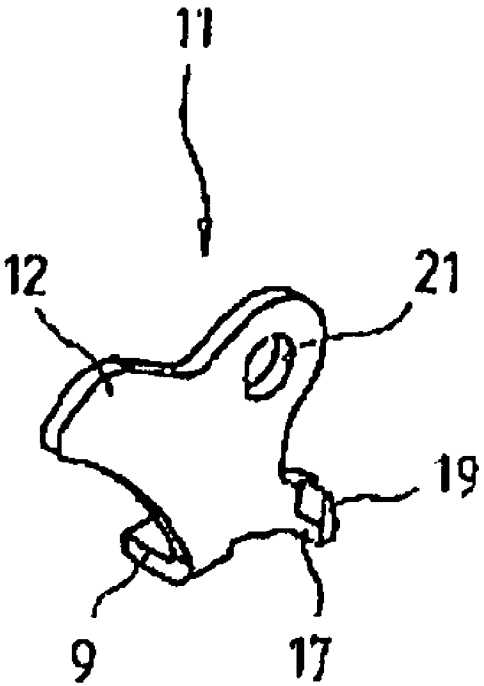
FIGS. 2A and 2B, a transmission element of the safety shown in FIG. 1 in two perspective views.
Figure 2A:
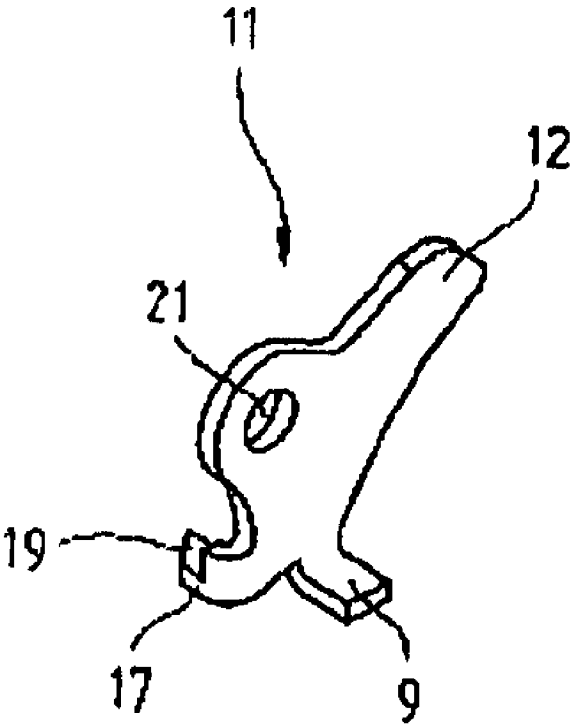

The transmission element 11 shown in FIGS. 2A and 2B in perspective view from both sides contains, in addition to the connecting piece 9 bent outwards, also an inward-projecting control element 17 that extends into a lateral recess 18 of the hammer 6 shown in FIG. 1 and that contains a rear, diagonal control surface 19 for engaging a radial cam 20 on the hammer 6. In the shown configuration, the control element 17 is embodied as an inward-bent bracket of the transmission element 11 and has a roof- or wedge-shaped cross-section. The transmission element 11 with a hole 21 is preferably formed as a stamped and bent part from sheet metal. The radial cam 20 located above the recess 18 is designed such that this is then led into contact with its control surface 19 for rotating the transmission element 11 only when the trigger 1 is activated. Otherwise, the control element 17 is led without contacting the hammer 6 into the recess 18 embodied, e.g., as an open cut section, so that the safety element 14 does not shift into the upper released position due to the hammer 6.

The function of the safety is explained in more detail below with reference to FIGS. 3–5.

Figure 3A:
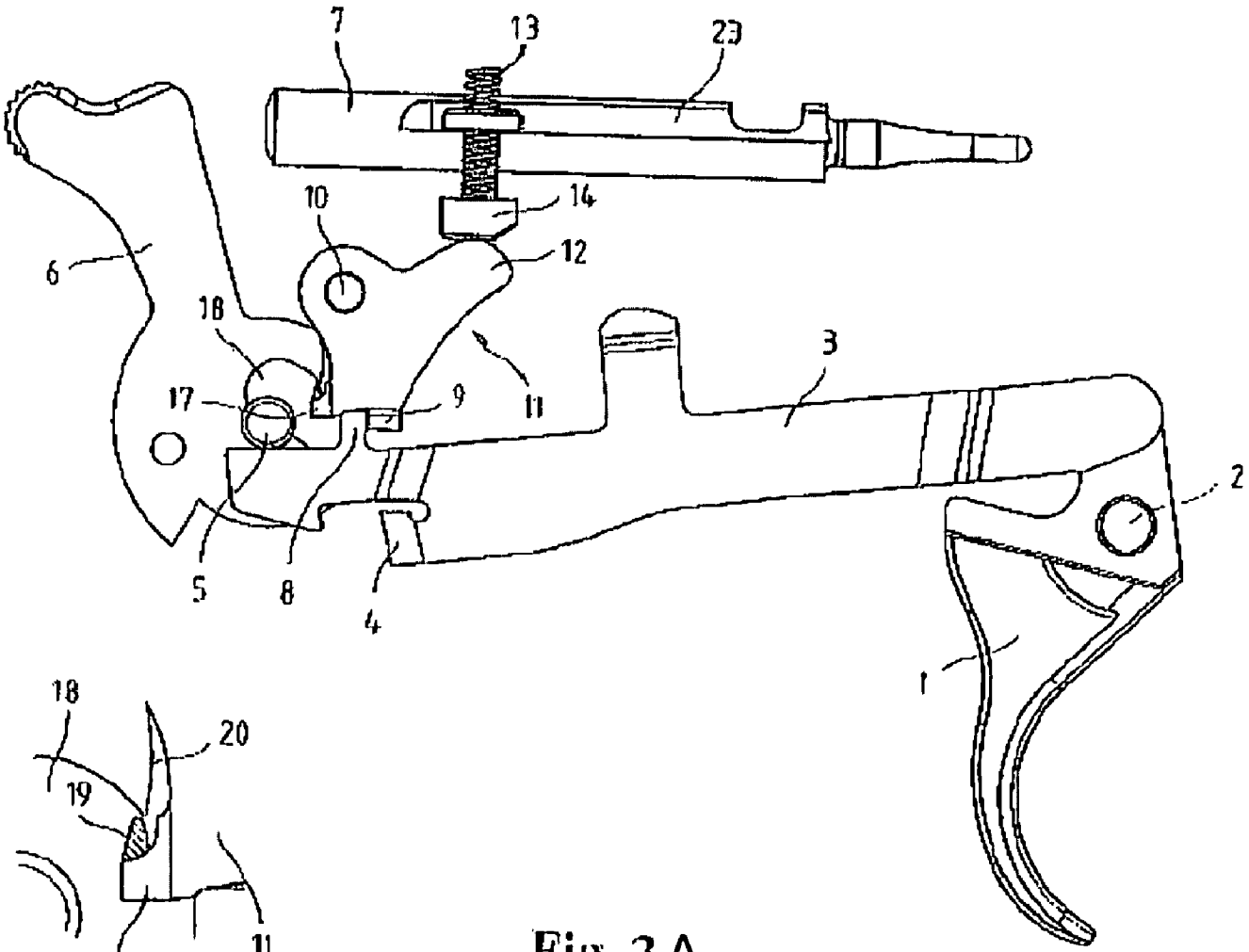
FIGS. 3A and 3B, a schematic side view of the safety shown in FIG. 1 in a starting position and a detailed view of the transmission element, respectively.
Figure 3B:
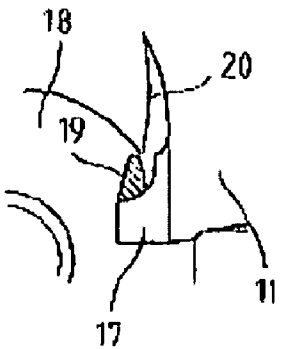

FIGS. 3A and 3B show an untensioned starting position, in which the trigger 1 is located in an unactivated front position and the hammer 6 is located in an untensioned position away from the firing pin 7. In this starting position, the safety element 14 embodied as a safety slide is forced by the spring 13 into the lower safety position, in which the projection 15, which cannot be seen here, engages in the associated groove 16 of the firing pin 7 and prevents its axial movement. The transmission element 11 embodied as a rotary lever receives a force from the safety element 14 biased downwards by the spring 13 such that the outward-bent tab 9 contacts the projection 8 of the trigger rod 3. As can be seen especially from the enlarged detailed view in FIG. 2B, the inward-pointing control projection 17 of the transmission element 11 engages in the recess 18 in this position without contacting the hammer 6, such that for an unactivated trigger 1, both in the shown position of the hammer 6 and also for unintended pulling of the trigger and striking of the hammer 6 on the firing pin 7, there is no contact between the firing lever 6 and the transmission element 11, and therefore also no further shifting of the safety element 14 into the released position. The safety element 14 remains in the bottom safety position, so that the firing pin 7 cannot move, and thus also cannot trigger an unintended shot.

Figure 4:
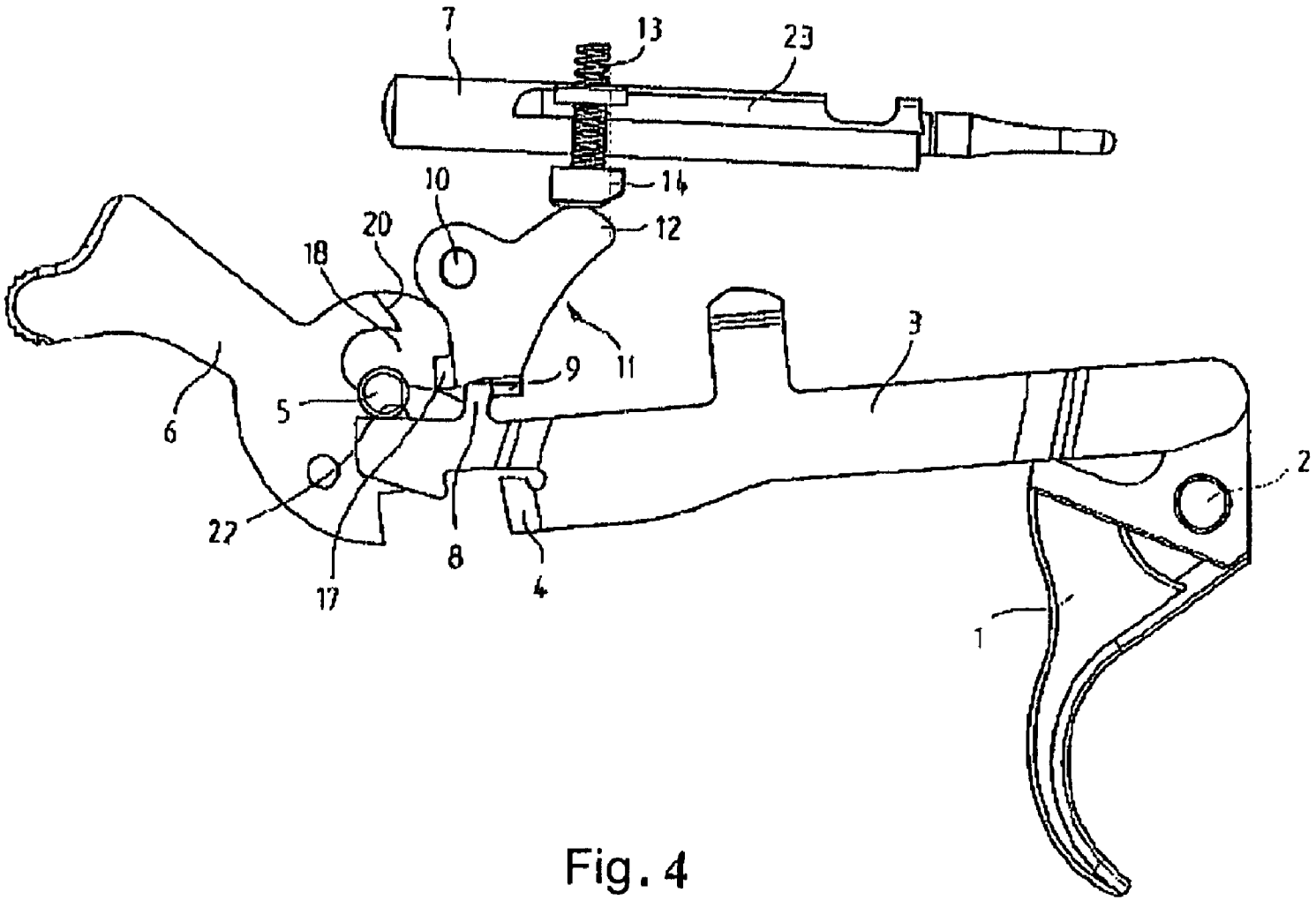
FIG. 4, a schematic side view of the safety shown in FIG. 1 in a starting position, and e.

FIG. 4 shows the safety shortly before the firing of a shot. The trigger 1 is located in a triggered position, wherein the trigger rod 3 has been moved forward and also downwards at its rear end through a control diagonal 22 in connection with the hammer shaft 5 simultaneously acting as a control element for releasing the hammer 6. In this way, the transmission element 11 was also turned in the counterclockwise direction by means of the tab 8 and the bent-forward connecting piece 9, and therefore the safety element 14 was shifted upwards into the shown intermediate position. In this intermediate position, the projection 15 of the safety element 14 is also still engaged in the lateral groove 16 of the firing pin 7 and prevents its movement.

Figures 5A, 5B:
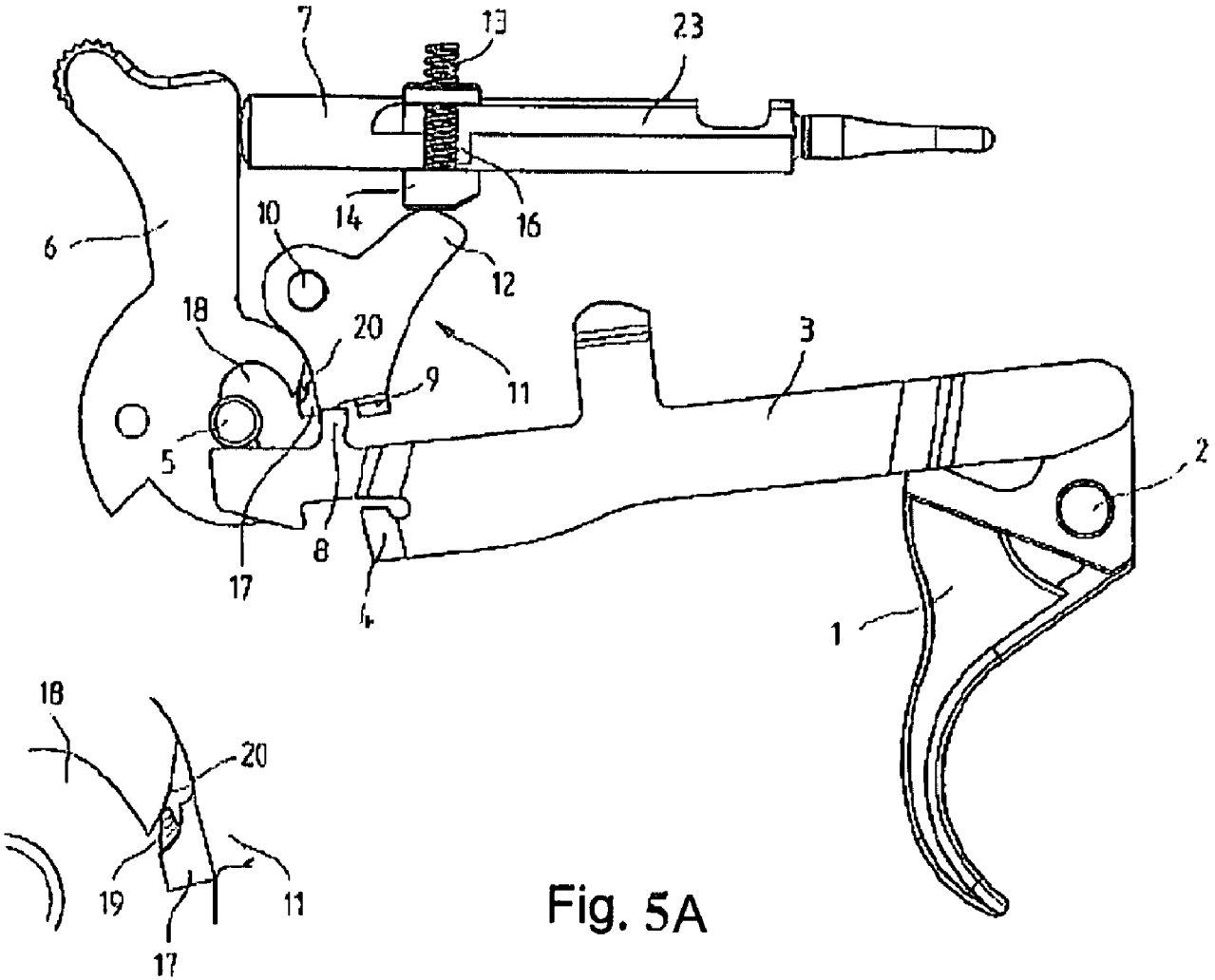
FIGS. 5A and 5B, a schematic side view of the safety shown in FIG. 1 in a released position and a detailed view of the transmission element, respectively.

When the hammer 6 is released in the position of FIG. 4, the radial cam 20 on the hammer 6 is led, shortly before it strikes the firing pin 7, into contact with the control surface 19 of the transmission element 11 and thus ensures that it is turned further in the counterclockwise direction and thus shifts the safety element 14 embodied as a control slide into the upper released position shown in FIGS. 5A and 5B. In the upper released position of the safety element 14, the rear projection 15 is located in a longitudinal open cut section 23 of the firing pin 7, so that the safety of the firing pin 7 is raised. The movement of the safety element 14 from the still-locked intermediate position into the upper released position is initiated by an activated trigger 1, thus by the hammer 6.

What is claimed is:

1. A hand firearm with a safety comprising:

a hammer;

a firing pin;

a safety element in contact with the firing pin;

a trigger rod connected with a trigger, the trigger rod movable by the trigger; and a transmission element in contact with the trigger rod and safety element such that rotation of the transmission element moves the safety element from a safety position for blocking the firing pin into a released position for releasing the firing pin, wherein the transmission element includes a control element, the control element configured for engagement with the hammer at a predetermined trigger position of the trigger for moving the safety element into the released position.

2. The hand firearm according to claim 1, wherein the control element is disposed in a recess of the hammer in the safety position, the control element having a control surface configured for engagement with a radial cam of the hammer in the predetermined trigger position of the trigger for moving the safety element into the released position.

3. The hand firearm according to claim 2, wherein the control element is an inwardly bent bracket, the control surface disposed on the rear side of the inwardly bent bracket.

4. The hand firearm according to claim 1, wherein the transmission element is a rotary lever rotatable about a shaft.

5. The hand firearm according to one of claim 1, wherein the safety element is a safety slide having a lateral projection for engaging safety groove of the firing pin.

6. The hand firearm according to claim 5, wherein the safety element is configured for movement between a lower safety position wherein the projection engages in the safety groove, and an upper released position wherein the projection is located in a lateral open cut section of the firing pin.

7. The hand firearm according to claim 5, wherein the safety element is biased by a spring into the safety position.

8. The hand firearm according to claim 1, wherein the transmission element is coupled to the trigger rod by an outwardly bent connecting piece.

9. The hand firearm according to claim 1, wherein the trigger rod includes an upward-projecting tab for engaging the transmission element.

10. A safety mechanism for a hand firearm, the safety mechanism comprising:

a hammer;

a firing pin having a safety groove;

a safety element having an inner projection configured for insertion in the safety groove of the firing pin, the safety element being movable relative to the firing pin such that in a locked configuration the inner projection is disposed in the safety groove, in an intermediate locked configuration the inner projection is also disposed in the safety groove, and in an unlocked configuration the inner projection is not disposed in the safety groove, wherein the inner projection of the safety element blocks longitudinal movement of the firing pin in the locked and intermediate locked configurations; and a transmission element having an upper end portion for moving the safety element from the locked configuration, to the intermediate locked configuration, and to the unlocked configuration, wherein the transmission element includes a control element, the control element configured for engagement with hammer at a predetermined position for moving the safety element into the released position.

11. The safety mechanism of claim 10 wherein the transmission element rotates on a shaft such that the upper end portion engages and moves the safety element.

12. A safety mechanism for a hand firearm, the safety mechanism comprising:

a firing pin having a safety groove;

a safety element having an inner projection configured for insertion in the safety groove of the firing pin, the safety element being movable relative to the firing pin such that in a locked configuration the inner projection is disposed in the safety groove, in an intermediate locked configuration the inner projection is also disposed in the safety groove, and in an unlocked configuration the inner projection is not disposed in the safety groove, wherein the inner projection of the safety element blocks longitudinal movement of the firing pin in the locked and intermediate locked configurations;

a transmission element having an upper end portion for moving the safety element from the locked configuration, to the intermediate locked configuration, and to the unlocked configuration, wherein the transmission element rotates on a shaft such that the upper end portion engages and moves the safety element;

a trigger rod having a tab, the trigger rod being movable such that the tab engages a connecting piece of the transmission element to rotate the transmission element about the shaft, movement of the trigger rod, transmission element, and safety element causing the safety mechanism to move from the locked configuration to the intermediate locked configuration: and hammer having a radial cam, the hammer being releasable by the trigger rod such that when released, the radial cam engages a control surface of the transmission element causing the safety element to move from the intermediate locked configuration to the unlocked configuration.

13. The safety mechanism of claim 12 further comprising a trigger connected with the trigger rod, initial movement of the trigger causing the trigger rod to rotate the transmission element and move the safety element from the locked configuration to the intermediate locked configuration, further movement of the trigger causing the trigger rod to release the hammer thereby causing the radial cam to engage the control surface and causing the transmission element to move the safety element from the intermediate locked configuration to the unlocked configuration.

* * * * *